US008157482B2

(12) United States Patent
Carpenter et al.

(10) Patent No.: US 8,157,482 B2
(45) Date of Patent: Apr. 17, 2012

(54) ANCHOR SYSTEM

(75) Inventors: Thomas J. Carpenter, Ankeny, IA (US); Larry K. Burk, Dubuque, IA (US)

(73) Assignee: Erosion Tech, LLC, Ankeny, IA (US)

( * ) Notice: Subject to any disclaimer, the term of this patent is extended or adjusted under 35 U.S.C. 154(b) by 369 days.

(21) Appl. No.: 12/322,701

(22) Filed: Feb. 5, 2009

(65) Prior Publication Data

US 2010/0196102 A1 Aug. 5, 2010

(51) Int. Cl.
*E21D 20/00* (2006.01)
*E21D 21/00* (2006.01)

(52) U.S. Cl. ..... 405/259.1; 405/253; 52/156

(58) Field of Classification Search ..... 405/258.1, 405/259.1, 259.7, 302.4, 302.6, 302.7, 303, 405/253; 52/155, 156, 166; 24/69 CT, 69 ST
See application file for complete search history.

(56) References Cited

U.S. PATENT DOCUMENTS

| | | | | | |
|---|---|---|---|---|---|
| 360,225 | A | | 3/1887 | Kantees | |
| 370,809 | A | * | 10/1887 | Nellis | 52/165 |
| 506,856 | A | * | 10/1893 | McElroy | 405/253 |
| 1,092,203 | A | | 6/1914 | Carter | |
| 1,940,938 | A | * | 12/1933 | Chance | 52/157 |
| 3,139,163 | A | | 6/1964 | Haller | |
| 3,342,444 | A | * | 9/1967 | Nelson | 52/165 |
| 3,570,254 | A | | 3/1971 | Turzillo | |
| 3,694,978 | A | * | 10/1972 | Mintz | 52/166 |
| 4,003,169 | A | | 1/1977 | Young | |
| 4,054,267 | A | | 10/1977 | Berg | |
| 4,096,673 | A | * | 6/1978 | Deike | 52/156 |
| 4,243,350 | A | | 1/1981 | Hall | |
| 4,269,010 | A | * | 5/1981 | Glass | 52/154 |
| 4,574,539 | A | * | 3/1986 | Deike | 52/163 |
| 4,596,731 | A | | 6/1986 | Cudmore et al. | |
| 4,610,568 | A | | 9/1986 | Koerner | |
| 4,611,446 | A | | 9/1986 | Beavers | |
| 4,727,693 | A | | 3/1988 | Rockenfeller | |
| 4,738,063 | A | * | 4/1988 | Alsop | 52/163 |
| 4,802,317 | A | | 2/1989 | Chandler | |
| 4,936,194 | A | | 6/1990 | Horowitz | |
| 5,020,938 | A | | 6/1991 | Scales | |
| 5,031,370 | A | | 7/1991 | Jewett | |
| 5,058,337 | A | | 10/1991 | O'Connor | |

(Continued)

OTHER PUBLICATIONS

Final OA mailed Sep. 8, 2009, U.S. Appl. No. 11/500,811.

(Continued)

*Primary Examiner* — Tara Mayo-Pinnock
(74) *Attorney, Agent, or Firm* — Shook, Hardy & Bacon L.L.P.

(57) ABSTRACT

An anchor system for securing a cable within the ground. The system includes a body having a tapered cap and an internal cylindrical slot provided therethrough. A driving rod having an end with a smaller diameter is provided through the slot so that the driving rod extends from the body of the anchor system. The body is provided with a catch through which a line is secured. The driving rod is utilized to drive the anchor system into the ground. As the driving rod extends from the body, the driving rod bears the brunt of the force associated with the driving action, allowing the anchor system to be constructed of a lightweight, inexpensive material. Once the anchor system has been provided at the desired depth, the driving rod is removed and the strap is pulled to set the anchor into place.

20 Claims, 6 Drawing Sheets

U.S. PATENT DOCUMENTS

| | | | | |
|---|---|---|---|---|
| 5,171,108 | A | | 12/1992 | Hugron |
| 5,175,966 | A | | 1/1993 | Remke |
| 5,256,007 | A | | 10/1993 | Allen |
| 5,358,356 | A | | 10/1994 | Romanek et al. |
| 5,364,206 | A | | 11/1994 | Marienfeld |
| 5,428,935 | A | | 7/1995 | Mitchell |
| 5,476,339 | A | | 12/1995 | Baranowski |
| 5,484,230 | A | | 1/1996 | Rudloff |
| 5,584,600 | A | | 12/1996 | Langdon |
| 5,636,944 | A | * | 6/1997 | Buttimore ..... 405/244 |
| 5,651,641 | A | | 7/1997 | Stephens et al. |
| 5,775,037 | A | | 7/1998 | James |
| 5,820,294 | A | | 10/1998 | Baranowski |
| 5,833,400 | A | | 11/1998 | Wamsher |
| 5,881,495 | A | * | 3/1999 | Clark ..... 47/48.5 |
| 5,881,506 | A | | 3/1999 | Chapman |
| 5,951,202 | A | | 9/1999 | Brown |
| 6,027,285 | A | | 2/2000 | Angel |
| 6,171,022 | B1 | | 1/2001 | Decker |
| 6,237,289 | B1 | | 5/2001 | Jewett |
| 6,370,827 | B2 | | 4/2002 | Chalich |
| 6,401,408 | B1 | | 6/2002 | Schwartz et al. |
| 6,461,084 | B1 | | 10/2002 | Stuart |
| 6,474,028 | B2 | | 11/2002 | Cusimano |
| 6,527,407 | B2 | | 3/2003 | Gluck |
| 6,558,074 | B2 | | 5/2003 | Jansson |
| 6,572,308 | B1 | | 6/2003 | Busto |
| 6,579,038 | B1 | | 6/2003 | McAllister et al. |
| 6,592,292 | B1 | | 7/2003 | Jansson |
| 6,612,776 | B1 | | 9/2003 | Jansson |
| 6,824,331 | B2 | | 11/2004 | Parker |
| 6,835,027 | B1 | | 12/2004 | Glass |
| 6,863,472 | B2 | | 3/2005 | Jansson |
| 6,942,421 | B2 | | 9/2005 | Jansson |
| 6,951,438 | B2 | | 10/2005 | Carpenter |
| 7,033,109 | B2 | | 4/2006 | Russell |
| 7,083,358 | B2 | | 8/2006 | Grosjean |
| 2001/0045068 | A1 | | 11/2001 | Chalich |
| 2003/0017000 | A1 | | 1/2003 | Jansson |
| 2003/0019080 | A1 | | 1/2003 | Anthony |
| 2003/0022134 | A1 | | 1/2003 | Seniuk |
| 2003/0082015 | A1 | | 5/2003 | Christensen |
| 2003/0228192 | A1 | | 12/2003 | Jansson |
| 2004/0013467 | A1 | | 1/2004 | Jansson |
| 2005/0078475 | A1 | | 4/2005 | Byers |

OTHER PUBLICATIONS

Non-final OA mailed Nov. 24, 2009, U.S. Appl. No. 11/500,811.
Non-final OA mailed Dec. 5, 2008, U.S. Appl. No. 11/500,811.
Non-final OA mailed Jan. 8, 2009, U.S. Appl. No. 12/214,346.
Non-final OA mailed Aug. 6, 2009, U.S. Appl. No. 12/214,346.
Notice of Allowance mailed Dec. 1, 2009, U.S. Appl. No. 12/214,346.
Non-final OA mailed Jun. 11, 2009, U.S. Appl. No. 11/827,639.
Non-final OA mailed Feb. 2, 2010, U.S. Appl. No. 11/827,639.
Notice of Allowance U.S. Appl. No. 12/715,904, Date Mailed Feb. 7, 2011.
Georunner Surface Protection System, two page brochure.
Final Office Action; Mail Date: Jun. 8, 2010; U.S. Appl. No. 11/500,811, filed Aug. 8, 2006, 8 pages.
Notice of Allowance; Mail Date: Jun. 11, 2010; U.S. Appl. No. 11/827,639, filed Jul. 12, 2007; 11 pages.
Notice of Allowance, U.S. Appl. No. 11/500,811, date mailed: Aug. 24, 2010.
Non-final Office Action, U.S. Appl. No. 12/715,904, date mailed: Sep. 15, 2010.

* cited by examiner

ANCHOR SYSTEM

BACKGROUND OF THE INVENTION

1. Field of the Invention

The present invention relates in general to an anchor system for anchoring material to the ground and, more particularly, to a lightweight, inexpensive anchoring system which allows for quick and easy insertion into the ground.

2. Description of the Prior Art

It is known in the art to provide duckbill anchors to anchor cables and the like into the ground. Duckbill type anchors are provided on one end with a hardened driving point, and on the other end with a slanted "duckbill." Through the duckbill is provided a slot, allowing the duckbill anchor to be engaged to a driving rod. Near the center of the duckbill anchor is a connection point where a steel cable or other type of line is connected to the anchor. The driving rod is used to push the duckbill anchor into the ground to a predetermined depth. The friction between the earth and the anchor retain the anchor as the driving rod is removed therefrom. Applying force to the cable causes the duckbill portion of the anchor to tilt so that the length of the anchor is nearly perpendicular to the cable. This near perpendicular orientation increases the surface area and, therefore, the drag against the earth as greater pressure is applied to the cable.

This system for insertion of the anchor against a surface of low frictional resistance and later tilting the anchor to provide high friction resistance, allows for easy insertion, strong cable retention and ease of operation.

One drawback associated with such prior art devices is the requirement that the duckbill anchor, and more specifically the driving portion of the duckbill anchor, be constructed of a strong, expensive material, such as hardened steel or the like. Although the driving point is only used briefly in the insertion of the duckbill anchor, use of a more inexpensive compound, such as plastic may cause the anchor to break or otherwise become inoperable when the anchor is driven into hard ground or when the anchor is deflected by a rock or similar rigid material.

While it is known in the art to provide other types of anchoring systems, these systems also require a hardened point on the anchor to withstand the driving process. As with the duckbill anchor, once these anchors have been provided to the desired depth and rotated, there is no longer a need for the hardened tips. It would, therefore, be desirable to provide a low-cost, lightweight anchor system which allowed for the anchor to be inserted into hard ground and withstand contact with abrasive material without the need for an expensive, hardened tip. The difficulties encountered in the prior art discussed hereinabove are substantially eliminated by the present invention.

SUMMARY OF THE INVENTION

In an advantage provided by this invention, an anchor system is provided which is of a lightweight, low-cost manufacture. Advantageously, this invention provides an anchor system which is easy to insert into the ground.

Advantageously, this invention provides an anchor system which is capable of being inserted into dense ground.

Advantageously, this invention provides an anchor system which is capable of being inserted into frozen or rocky ground.

Advantageously, this invention provides an anchor system which can withstand deflection by rigid material during insertion.

Advantageously, this invention provides an anchor system which resists decomposition.

Advantageously, in a preferred example of this invention, an anchor system is provided. The anchor system includes an anchor having a generally cylindrical body and a frusto conical cap. Provided through the body is a slot, through which is provided a driver. Preferably, the driver extends through the frusto conical cap of the body to expose the tip of the driver. Coupled to the body is a catch, to which is secured a line. The driver is used to insert the body into the ground to a predetermined depth. Once a predetermined depth is reached, the driver is removed and force is applied to the line to wedge the anchor against removal. Preferably, the portion of the body opposite the frusto conical cap is flat or otherwise provided with a large surface area to resist dislodgement of the anchor from the ground once it has been inserted.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
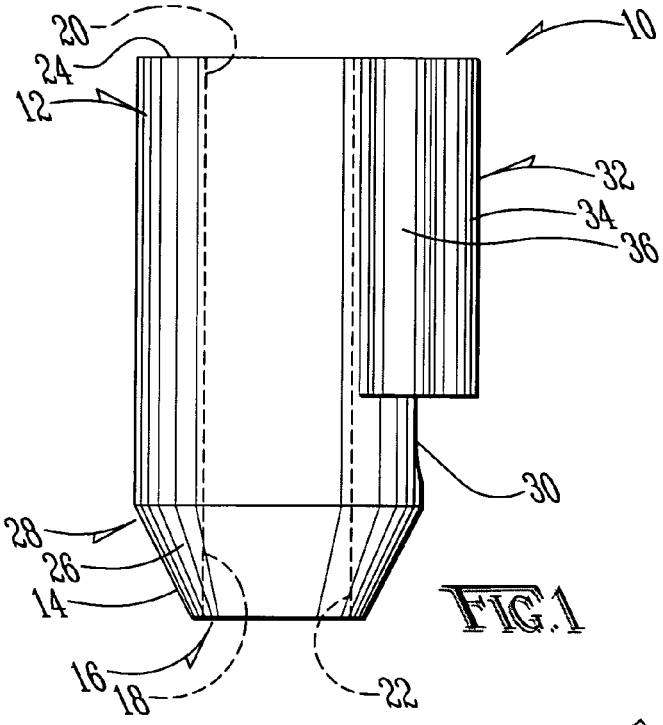
FIG. 1 shows a side elevation of the anchor system of the present invention.

An anchor system according to this invention is shown generally as (10) in FIG. 1. The anchor system (10) is preferably integrally molded of a single piece of polyvinylchloride. It should be noted, however, that the anchor system may be constructed of any suitable material known in the art. Polyvinylchloride is particularly desirable as it is lightweight, low-cost and may be readily configured into the desired shape. An additional advantage of polyvinylchloride is its tendency to resist decomposition when inserted into the ground, as compared with untreated iron and the like. The anchor system (10) includes a cylindrical body (12), preferably 5.0 centimeters in length and 2.5 centimeters in diameter.

Figure 2:
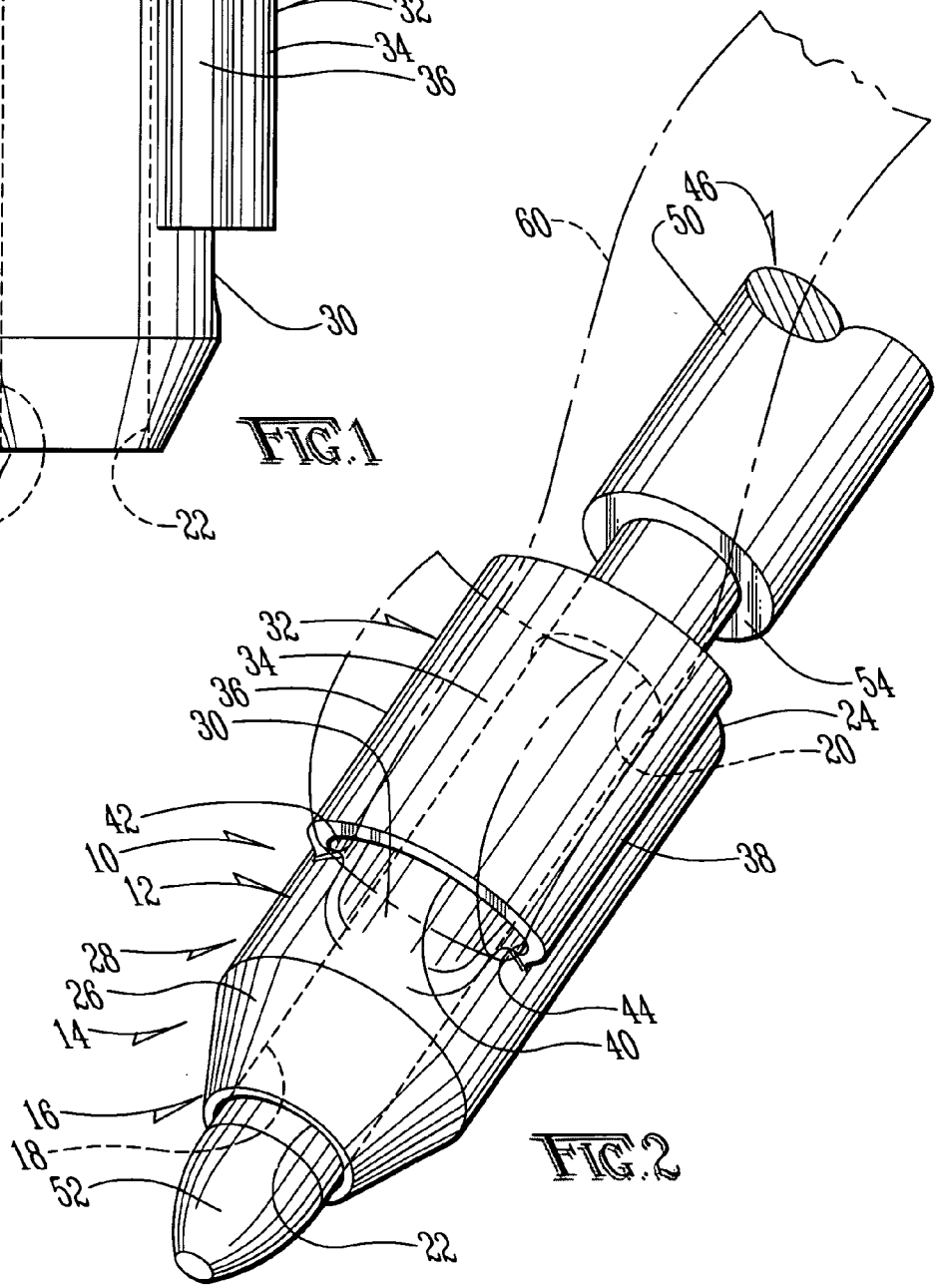
FIG. 2 shows a top perspective view in partial phantom of the anchor system of FIG. 1.
Figure 3:
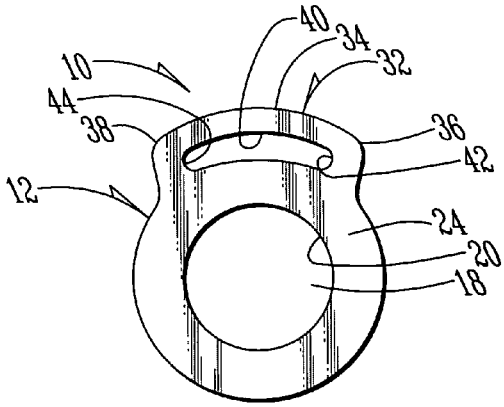
FIG. 3 shows a rear elevation of the anchor system of FIG. 1.

The anchor system (10) is preferably 5.0 centimeters in length and 2.5 centimeters in diameter. The anchor system (10) is provided with a cylindrical body (12) 4.0 centimeters in length, which tapers the last 1.0 centimeter to a head (16), preferably 1.5 centimeters in diameter. As shown in FIG. 2, the body (12) is provided with a cylindrical slot (18) having an entrance (20) and an exit (22), as shown in FIG. 3. The entrance (20) and exit (22) are preferably 1.3 centimeters in diameter. If desired, the exit (22) may be of a slightly smaller diameter than the entrance (20). The entrance (20) is provided on a foot (24) of the body (12) having a diameter of 2.5 centimeters. The foot (24) is provided with a drag face (26). While the drag face (26) is preferably flat, it may be provided with serrations (not shown) or any other configuration to increase the drag associated with the drag face (26) contacting soil (not shown) or other material.

The anchor system (10) is provided with a cap (28) which tapers from the 2.5 centimeter diameter of the cylindrical body (12) to the 1.5 centimeter diameter of the head (16). As shown in FIG. 2, provided on the body (12) is a recessed arcuate portion (30) which extends from the cap (28) to the foot (24). Provided over a portion of the recessed arcuate portion is a catch (32) integrally molded with the body (12) of polyvinylchloride.

As shown in FIGS. 2 and 3, the catch (32) is provided with an arcuate face (34) and a pair of arcuate sides (36) and (38) which couple the arcuate face (34) to the body (12). The recessed arcuate portion (30) and arcuate face (34) form an arcuate opening (40). The catch (32) is preferably 2.1 centimeters wide and 3.0 centimeters long. The arcuate opening (40) is preferably 1.5 centimeters in length. The arcuate opening (40) is provided with interior arcuate corners (42) and (44).

All of the dimensions provided within the specification may be reduced ninety percent or increased one thousand percent, more preferably reduced up to seventy-five percent and increased up to five hundred percent and, most preferably, reduced up to fifty percent and increased up to two hundred percent. Additionally, although the body is described as being cylindrical, any desired configuration, such as a round, rectangular, triangular or oblong cross section may be provided.

Figure 4:
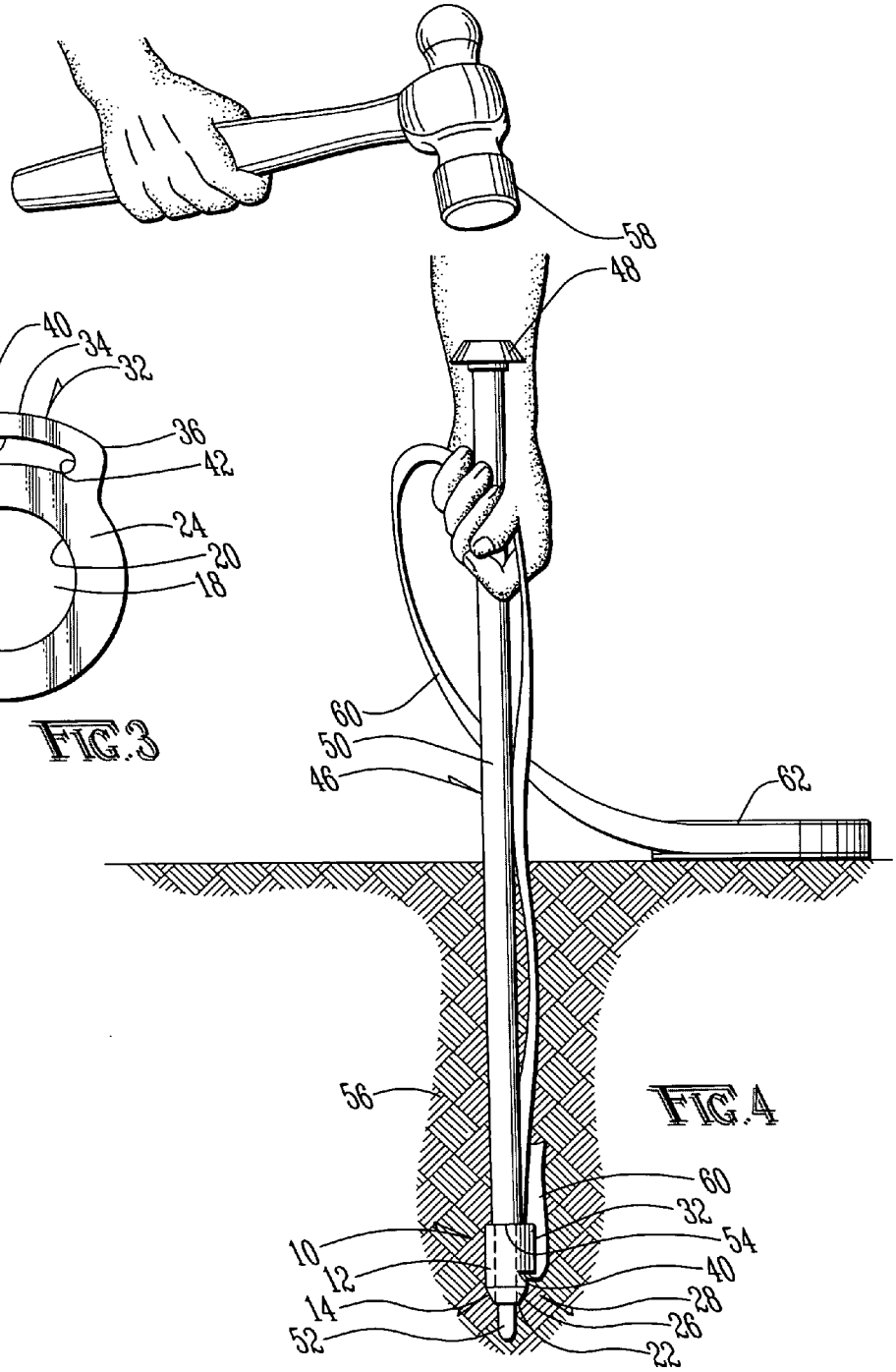
FIG. 4 shows a side elevation of the anchor system of the present invention being attached to a securement line and being provided into the ground.
Figures 5A, 5B:
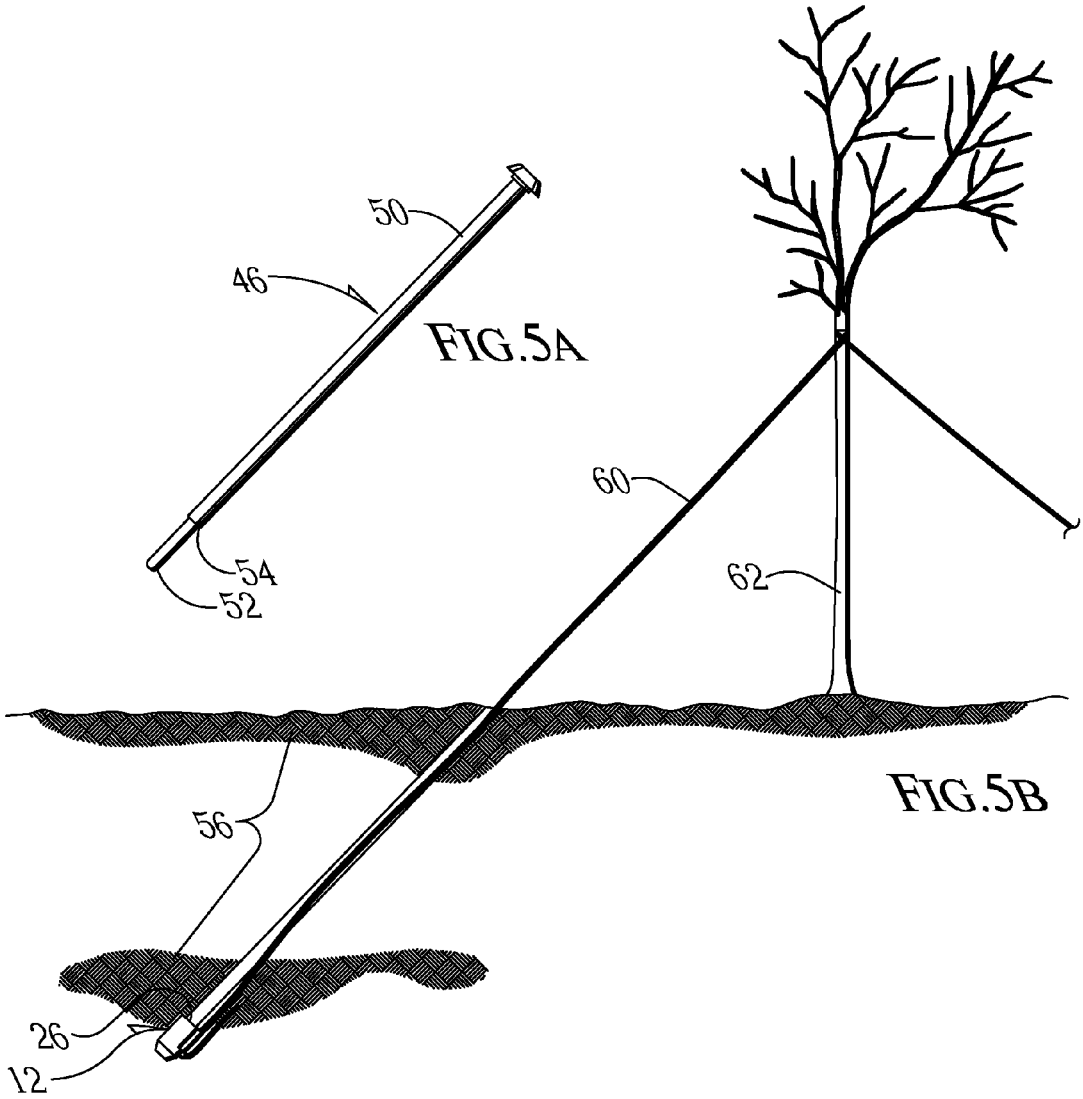
FIG. 5A depicts a driver suitable for use in embodiments of the invention.
FIG. 5B shows the anchor system of the present invention being used to secure a tree.

As shown in FIG. 4, when it is desired to utilize the anchor system of the present invention, a driver (46) is provided, having an enlarged head (48) coupled to a steel shaft (50). The shaft (50) is preferably about one meter in length and 1.9 centimeters in diameter. Approximately 7.6 centimeters from the end, the shaft (50) is stepped to a diameter of 1.2 centimeters. About one centimeter from the end, the shaft (50) tapers to a hardened frusto conical face (52). (FIGS. 3 and 5). Accordingly, as shown in FIG. 4, when the driver (46) is inserted into the body (12) of the anchor system (10), the stepped shoulder (54) of the driver (46) engages the drag face (26) of the body (12) and the face (52) protrudes through the exit (22) of the body (12) about 1.3 centimeters. As the driver (46) is pounded into the earth (56), by a hammer (58) or the like, the face (52) of the driver (46) bears the brunt of the abrasion and impact associated with being driven into the earth (56), thereby reducing the impact upon the integrity of the body (12). The tapered cap (28) of the body (12) assists in pushing the earth (56) away from the body (12) as the driver (46) continues to be driven into the earth (56).

As shown in FIG. 4, before the body (12) is driven into the earth (56) by the driver (46), a line, such as a strap (60), is provided through the arcuate opening (40) of the catch (32) and bent back against the arcuate face (34) of the catch (32). The slight curvature of the arcuate opening (40) and the bending back of the strap (60) against this curvature along the arcuate face (34) of the catch (32) retains the strap (60) in place as the body (12) is driven into the earth (56). As shown in FIG. 4, the strap (60) may be provided from a spool to allow the desired amount of strap (60) to be inserted into the earth (56) with minimal waste. Once the strap (60) has been provided through the arcuate opening (40) of the catch (32), and the body (12) provided over the face (52) of the driver (46), the hammer (58) is used to drive the face (52) and body (12) a desired depth into the earth (56), preferably at least 0.5 meters.

As shown in FIG. 5, once the desired depth has been reached, the driver (46) is removed, pulling free of the body (12). The drag face (26) of the body (12) contacts the earth (56), thereby preventing the body (12) from becoming dislodged from the earth (56) along with the driver (46). Once the driver (46) has been removed, the strap (60) is pulled to cause the drag face (26) of the body (12) to wedge sufficiently into the earth (56) to prevent inadvertent removal of the strap (60). The strap (60) may then be used for any desired purpose, such as to brace a tree (62) or the like. As shown in FIG. 5, the driver (46) may be driven into the earth (56) at an angle or, as shown in FIG. 6, the body (12) may be driven into the earth (56) normal to the surface (64) of the earth (56).

Figure 6:
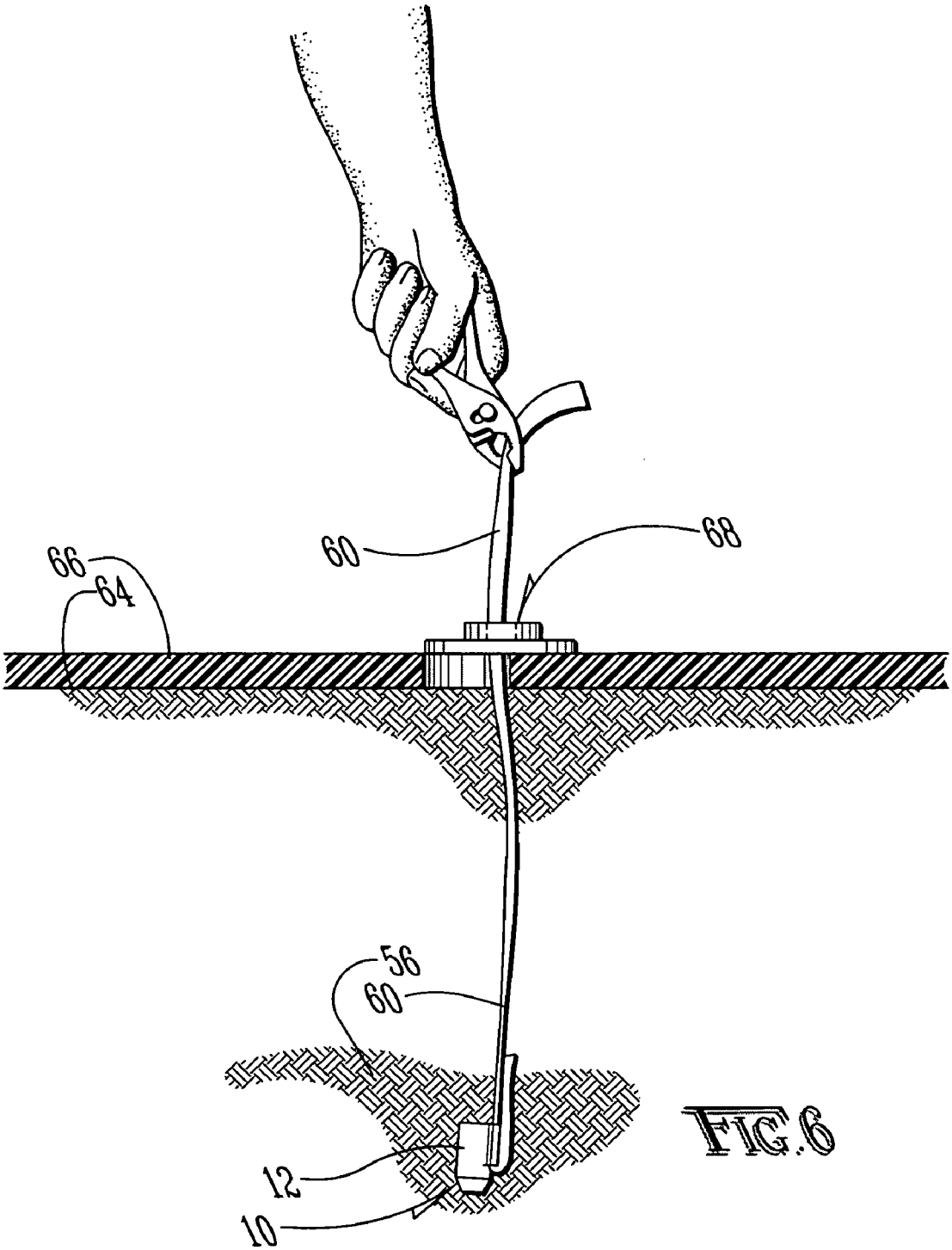
FIG. 6 shows the anchor system of the present invention used to secure an erosion control mat.

As shown in FIG. 6, the anchor system (10) may also be used to secure an erosion control surface (66) to the surface (64) of the earth (56). As shown in FIG. 6, the strap (60) may be cut, preferably ten to twenty centimeters above the top of the erosion control surface (66). Thereafter, a locking mechanism (68) may be secured to the strap (60) to prevent the erosion control surface (66) from becoming dislodged from the strap (60).

Figure 7:
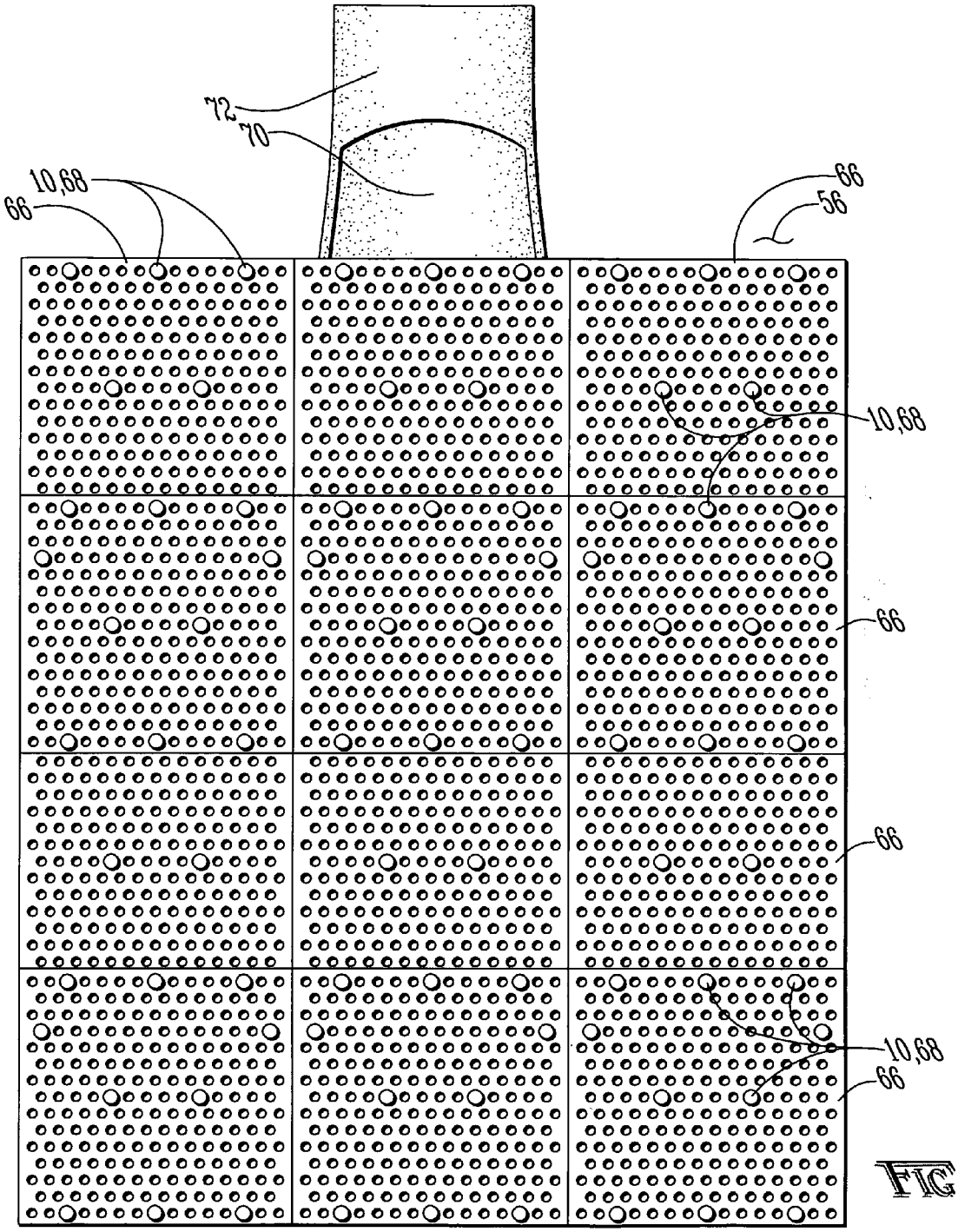
FIG. 7 shows a plurality of anchor systems of the present invention being used to secure a plurality of erosion control mats.

As shown in FIG. 7, a plurality of anchor systems, such as those described above, may be utilized in association with a plurality of erosion control surfaces (66) to secure a large area of earth (56) against erosion at the outlet (70) of an effluent discharger (72), such as a parking lot water discharge or the like.

Figure 8:
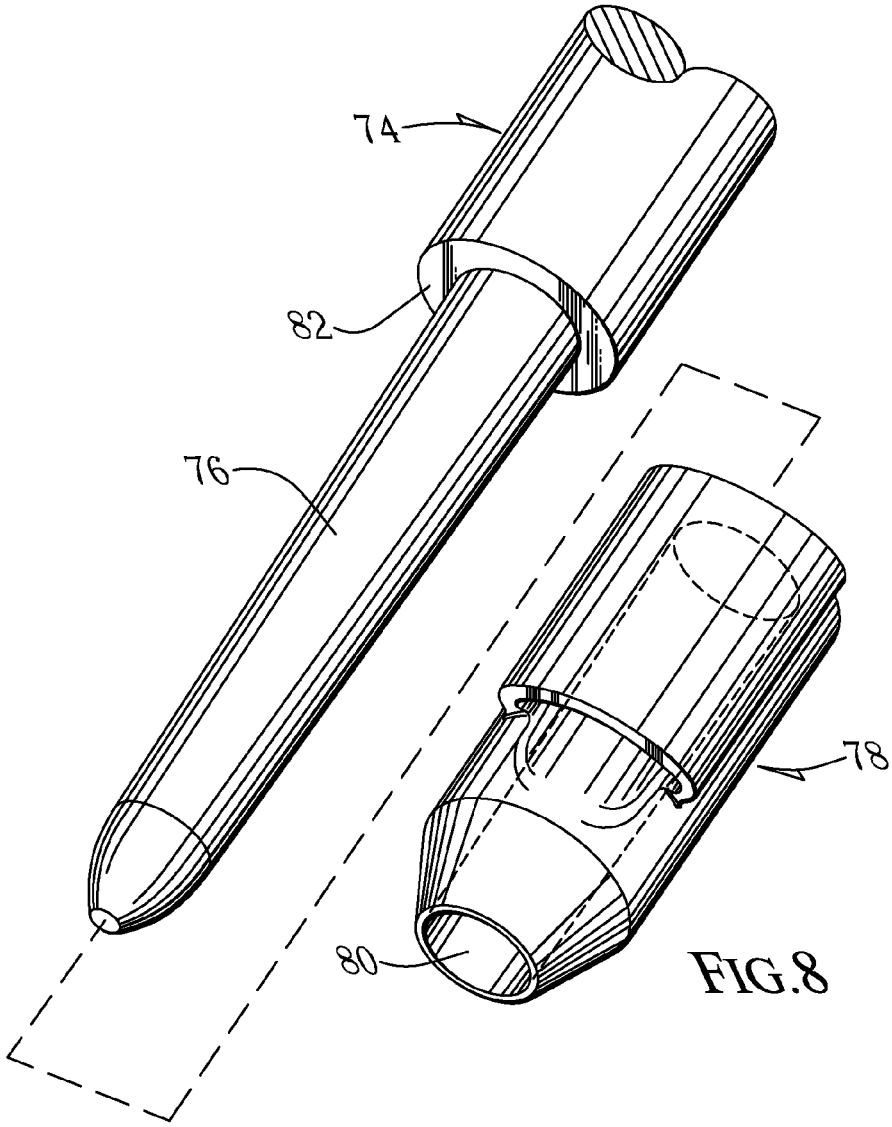
FIG. 8 shows a top perspective view in partial phantom of an alternative embodiment of the anchor system.

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. The anchor system (10) may, of course, be utilized with any desired type of strap (60), cable or line, constructed of any suitable material, including, but not limited to, metal or rope. Similarly, the strap (60) may be secured to any type of object desired to be secured. Alternatively, as shown in FIG. 8, the driver (74) may be provided long tapered end (76) to fit into a body (78) having a frusto conical slot (80). The driver (74) may be provided with or without a stepped shoulder (82).

What is claimed is:

1. An anchor system comprising:

an anchor comprising:

a body having a head and a foot, the body defining a slot and being tapered toward the head, and a catch secured to the body, the catch defining an elongate opening that extends along the body parallel to the slot;

a line coupled to the catch;

a driver provided in the slot, the driver including a shaft and an end coupled to the shaft, the end having a diameter smaller than that of the shaft and of slot, the end extending through the slot and protruding from the head of the anchor, and the shaft abutting the foot of the anchor.

2. The anchor system of claim 1, wherein the shaft is provided with a first diameter and the end is provided with a second diameter, and wherein the first diameter is greater than the second diameter.

3. The anchor system of claim 1, wherein the end is tapered.

4. The anchor system of claim 3, wherein the end is frusto conical.

5. The anchor system of claim 1, wherein the catch defines an opening having a length and a width, wherein the length is at least twice as long as the width.

6. The anchor system of claim 5, wherein the opening is arcuate.

7. The anchor system of claim 1, wherein the catch is integrally molded within the body.

8. The anchor system of claim 1, wherein the foot of the body is provided with a drag face.

9. An anchor system comprising:

an anchor comprising:

a body having a head, a foot and defining a slot that includes an entrance and an exit, the entrance corresponding with the foot and the exit corresponding with the head, and the entrance being larger than the exit, and a catch coupled to the body, the catch defining an elongate opening that extends along a portion of the exterior of the body parallel to the slot;

a line coupled to the catch; and a driver provided within the slot and extending from the entrance through the slot and extending beyond the exit.

10. The anchor system of claim 9, wherein the driver comprises:

a shaft that abuts the foot proximate to the entrance; and an end coupled to the shaft that extends from the shaft through the slot and the exit.

11. The anchor system of claim 10, wherein the shaft and the end are cylindrical, and wherein the shaft has a greater diameter than the end.

12. The anchor system of claim 10, wherein the end is tapered.

13. The anchor system of claim 10, wherein the end is frusto conical.

14. The anchor system of claim 9, wherein the catch defines an opening having a length and a width, wherein the length is at least twice as long as the width.

15. The anchor system of claim 14, wherein the opening is arcuate.

16. The anchor system of claim 9, wherein the slot tapers toward the exit.

17. An anchor comprising:

a cylindrical body defining a cylindrical slot having an entrance and an exit, the body tapering toward the exit and providing a drag face proximate to the entrance;

a catch provided on the body, the catch defining an opening that extends parallel to the slot, the opening formed by a recessed surface on the exterior of the body and an interior surface of the catch, and the catch configured to receive a strap that is inserted into a first end corresponding with the entrance, the strap extending beyond a second end of the catch and being folded back onto the catch.

18. The anchor of claim 17, wherein the drag face surrounds the entrance.

19. The anchor of claim 18, wherein the opening is arcuate.

20. The anchor of claim 19, wherein the slot is normal to the drag face.

* * * * *